US009975004B2

(12) United States Patent
Sajima et al.

(10) Patent No.: US 9,975,004 B2
(45) **Date of Patent: *May 22, 2018**

(54) GOLF BALL

(71) Applicant: DUNLOP SPORTS CO. LTD., Kobe-shi, Hyogo (JP)

(72) Inventors: Takahiro Sajima, Kobe (JP); Kohei Mimura, Kobe (JP)

(73) Assignee: DUNLOP SPORTS CO. LTD., Kobe-Shi, Hyogo (JP)

( * ) Notice: Subject to any disclaimer, the term of this patent is extended or adjusted under 35 U.S.C. 154(b) by 0 days. days.

This patent is subject to a terminal disclaimer.

(21) Appl. No.: 14/752,491

(22) Filed: Jun. 26, 2015

(65) Prior Publication Data

US 2015/0375047 A1 Dec. 31, 2015

(30) Foreign Application Priority Data

Jun. 27, 2014 (JP) ..... 2014-131995

(51) Int. Cl.
*A63B 37/06* (2006.01)
*A63B 37/00* (2006.01)

(52) U.S. Cl.
CPC ..... *A63B 37/0006* (2013.01); *A63B 37/002* (2013.01); *A63B 37/0004* (2013.01); *A63B 37/0016* (2013.01); *A63B 37/0017* (2013.01); *A63B 37/0018* (2013.01); *A63B 37/0021* (2013.01); *A63B 37/0077* (2013.01)

(58) Field of Classification Search
CPC ..... A63B 37/0006
USPC ..... 473/378
See application file for complete search history.

(56) References Cited

U.S. PATENT DOCUMENTS 5,688,194 A * 11/1997 Stiefel ..... A63B 37/0004 33/1 G
9,550,093 B2 * 1/2017 Mimura ..... A63B 37/0006
2002/0010039 A1 * 1/2002 Ogg ..... A63B 37/0004 473/383
2007/0149321 A1 6/2007 Sajima
2007/0173354 A1 * 7/2007 Sajima ..... A63B 37/0004 473/378
2007/0298908 A1 12/2007 Sajima
(Continued)

FOREIGN PATENT DOCUMENTS

JP 8-257167 A 10/1996
JP 2008-389 A 1/2008
JP 2010-88554 A 4/2010

*Primary Examiner* — Raeann Gorden
(74) *Attorney, Agent, or Firm* — Birch, Stewart, Kolasch & Birch, LLP

(57) ABSTRACT

A golf ball 2 includes a large number of dimples 10 on a surface thereof. The surface has a northern hemisphere N and a southern hemisphere S. Each of the hemispheres has a high-latitude region 14, a mid-latitude region 18 and a low-latitude region 16. The high-latitude region 14 has a latitude range of 40° or greater but 90° or less. The mid-latitude region 18 has a latitude range of 20° or greater but less than 40°. The low-latitude region 16 has a latitude range of 0° or greater but less than 20°. The number of planes that can divide a dimple pattern of the hemisphere so that divided dimple patterns are mirror symmetry to each other is one. Neither a dimple pattern of the high-latitude region 14 nor a dimple pattern of the low-latitude region 16 is rotationally symmetrical.

8 Claims, 12 Drawing Sheets

(56) References Cited

U.S. PATENT DOCUMENTS

| | | | | |
|---|---|---|---|---|
| 2008/0039236 | A1* | 2/2008 | Isogawa | A63B 37/0004 473/378 |
| 2008/0188327 | A1 | 8/2008 | Tapper et al. | |
| 2009/0102097 | A1* | 4/2009 | Sajima | A63B 37/0004 264/299 |
| 2009/0191982 | A1 | 7/2009 | Kim et al. | |
| 2010/0190584 | A1* | 7/2010 | Sajima | A63B 37/0004 473/384 |
| 2011/0034274 | A1* | 2/2011 | Sajima | A63B 37/0006 473/384 |
| 2012/0004053 | A1 | 1/2012 | Kim | |
| 2013/0196791 | A1 | 8/2013 | Sajima et al. | |
| 2013/0324323 | A1 | 12/2013 | Yontz | |

* cited by examiner

GOLF BALL

This application claims priority on Patent Application No. 2014-131995 filed in JAPAN on Jun. 27, 2014. The entire contents of this Japanese Patent Application are hereby incorporated by reference.

BACKGROUND OF THE INVENTION

Field of the Invention

The present invention relates to golf balls. Specifically, the present invention relates to improvement of aerodynamic characteristic of golf balls.

Description of the Related Art

Golf balls have a large number of dimples on the surfaces thereof. The dimples disturb the air flow around the golf ball during flight to cause turbulent flow separation. This phenomenon is referred to as "turbulization". Due to the turbulization, separation points of the air from the golf ball shift backwards leading to a reduction of drag. The turbulization promotes the displacement between the separation point on the upper side and the separation point on the lower side of the golf ball, which results from the backspin, thereby enhancing the lift force that acts upon the golf ball. Excellent dimples efficiently disturb the air flow. The excellent dimples produce a long flight distance.

A polyhedron is used for arrangement of dimples. The polyhedron is inscribed in a phantom sphere of a golf ball. A large number of sides of the polyhedron are projected on the surface of the phantom sphere by a light beam travelling from the center of the phantom sphere in a radius direction. A large number of comparting lines are obtained on the surface of the phantom sphere by the projection. By the comparting lines, the surface of the phantom sphere is divided into a large number of units (spherical polygons). A large number of dimples are arranged in one unit to obtain a dimple pattern. The dimple pattern is developed over the other units to obtain a dimple patter of the whole golf ball. This dimple patter is referred to as a polyhedron pattern.

A dimple pattern referred to as a hemispherically divided pattern is adopted in commercially available golf balls. In designing the pattern, a hemisphere (half of a phantom sphere) is divided into a plurality of units by a plurality of longitude lines. Each unit has a shape of a spherical isosceles triangle. A large number of dimples are arranged in one unit to obtain a dimple pattern. The dimple pattern is developed over the other units. The development is obtained by rotating one unit pattern about a line passing through a north pole and a south pole. By the rotation, a dimple pattern of the whole golf ball is obtained. The pattern of the golf ball is rotationally symmetrical.

The polyhedron pattern is monotonous. In the polyhedron pattern, the turbulization is insufficient. The hemispherically divided pattern is also monotonous. In the hemispherically divided pattern, the turbulization is insufficient.

There have been various proposals for improvement of the hemispherically divided pattern. US2007/0149321 (JP2007-175267) discloses a dimple pattern in which the number of units present in a high-latitude region is different from the number of units present in a low-latitude region. US2007/0173354 (JP2007-195591) discloses a dimple pattern in which the number of types of dimples present in a low-latitude region is greater than the number of types of dimples present in a high-latitude region. US2013/0196791 (JP2013-153966) discloses a dimple pattern in which the density of dimples is high and variations in sizes of dimples are small.

US2009/0191982 (JP2009-172192) discloses a golf ball that has randomly arranged dimples. The dimple pattern of the golf ball is referred to as a random pattern. The random pattern is not monotonous. US2012/0004053 (JP2012-10822) also discloses a golf ball having a random pattern.

Golf players place importance on flight distance in a shot with an iron club as well as flight distance in a shot with a driver. Players particularly place importance on flight distance in a shot with a middle iron and a long iron. A spin rate of a golf ball in hitting with a middle iron is high. If a golf ball having above mentioned improved hemispherically divided pattern is hit with a middle iron, an excessive lift force is generated. The lift force may cause rising of the golf ball during flight. The rising impairs flight distance performance. In addition, in the golf ball, the flight distance depends largely on the rotation axis of backspin. In other words, the golf ball is inferior in stability of flight distance.

As already mentioned, the random pattern is not monotonous. However, the density of dimples in the random pattern is low. In the pattern, suppression of drag is insufficient. When the golf ball is hit with a middle iron, great flight distance cannot be achieved.

An objective of the present invention is to provide a golf ball that is excellent in flight distance performance and flight distance stability in a shot with a middle iron.

SUMMARY OF THE INVENTION

A golf ball according to the present invention includes a large number of dimples on a surface thereof. When the surface is divided into a northern hemisphere and a southern hemisphere, each of the hemispheres includes a high-latitude region, a mid-latitude region, and a low-latitude region. The high-latitude region has a latitude range of equal to or greater than 40° but equal to or less than 90°. The mid-latitude region has a latitude range of equal to or greater than 20° but less than 40°. The low-latitude region has a latitude range of equal to or greater than 0° but less than 20°. The number of planes that can divide a dimple pattern of the hemisphere so that divided dimple patterns are mirror symmetrical to each other is one. A dimple pattern of the high-latitude region is not rotationally symmetrical. A dimple pattern of the low-latitude region is not rotationally symmetrical.

In the golf ball according to the present invention, a great flight distance is obtained in a shot with a middle iron. In the golf ball, variations of flight distances in shots with a middle iron are small.

Preferably, a dimple pattern of the mid-latitude region is not rotationally symmetrical.

The high-latitude region may include a pole vicinity region. The pole vicinity region has a latitude range of equal to or greater than 75° but equal to or less than 90°. Preferably, a dimple pattern of the pole vicinity region is rotationally symmetrical.

The low-latitude region may include an equator vicinity region. The equator vicinity region has a latitude range of equal to or greater than 0° but less than 10°. Preferably, a dimple pattern of the equator vicinity region is rotationally symmetrical.

Preferably, a great circle that does not intersect any dimple does not exist on the surface of the golf ball.

Preferably, a ratio of a total area of all the dimples to a surface area of a phantom sphere of the golf ball is equal to or greater than 80%.

DESCRIPTION OF THE PREFERRED EMBODIMENTS

The following will describe in detail the present invention based on preferred embodiments with reference to the accompanying drawings.

Figure 1:
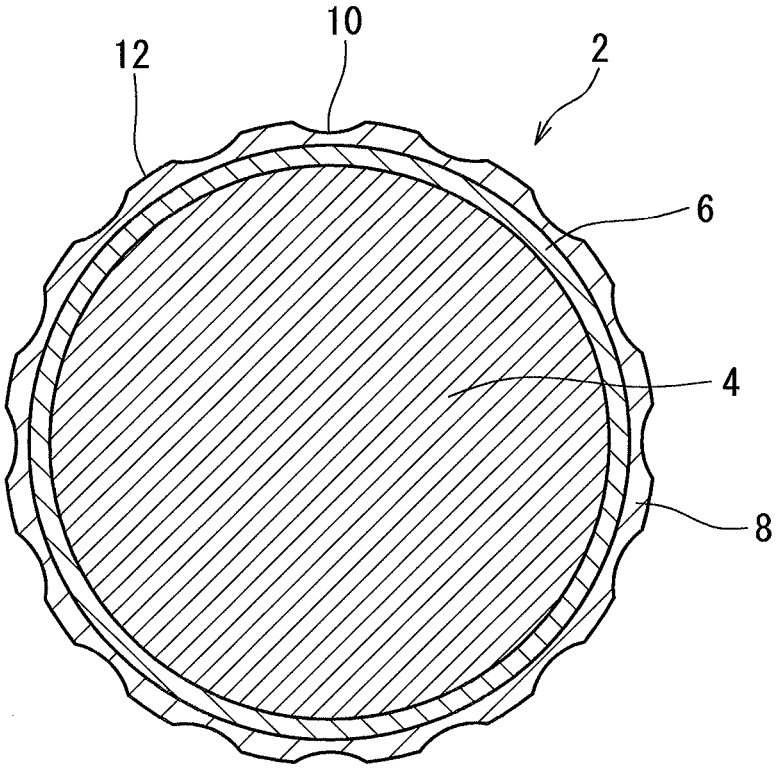
FIG. 1 is a schematic cross-sectional view of a golf ball according to an embodiment of the present invention.

A golf ball 2 shown in FIG. 1 includes a spherical core 4, a mid layer 6 positioned outside the core 4, and a cover 8 positioned outside the mid layer 6. The golf ball 2 has a large number of dimples 10 on a surface thereof. Of the surface of the golf ball 2, a part other than the dimples 10 is a land 12. The golf ball 2 includes a paint layer and a mark layer on the external side of the cover 8, although these layers are not shown in the drawing.

The golf ball 2 has a diameter of preferably 40 mm or greater but 45 mm or less. From the standpoint of conformity to the rules established by the United States Golf Association (USGA), the diameter is particularly preferably equal to or greater than 42.67 mm. In light of suppression of air resistance, the diameter is more preferably equal to or less than 44 mm and particularly preferably equal to or less than 42.80 mm. The golf ball 2 has a weight of preferably 40 g or greater but 50 g or less. In light of attainment of great inertia, the weight is more preferably equal to or greater than 44 g and particularly preferably equal to or greater than 45.00 g. From the standpoint of conformity to the rules established by the USGA, the weight is particularly preferably equal to or less than 45.93 g.

The core 4 is formed by crosslinking a rubber composition. Examples of the base rubber of the rubber composition include polybutadienes, polyisoprenes, styrene-butadiene copolymers, ethylene-propylene-diene copolymers, and natural rubbers. Two or more rubbers may be used in combination. In light of resilience performance, polybutadienes are preferred, and high-cis polybutadienes are particularly preferred.

The rubber composition of the core 4 includes a co-crosslinking agent. Examples of preferable co-crosslinking agents in light of resilience performance include zinc acrylate, magnesium acrylate, zinc methacrylate, and magnesium methacrylate. The rubber composition preferably includes an organic peroxide together with a co-crosslinking agent. Examples of preferable organic peroxides include dicumyl peroxide, 1,1-bis(t-butylperoxy)-3,3,5-trimethylcyclohexane, 2,5-dimethyl-2,5-di(t-butylperoxy) hexane, and di-t-butyl peroxide.

The rubber composition of the core 4 may include additives such as a filler, sulfur, a vulcanization accelerator, a sulfur compound, an anti-aging agent, a coloring agent, a plasticizer, a dispersant, a carboxylic acid, a carboxylate, and the like. The rubber composition may include synthetic resin powder or crosslinked rubber powder.

The core 4 has a diameter of preferably 30.0 mm or greater and particularly preferably 38.0 mm or greater. The diameter of the core 4 is preferably equal to or less than 42.0 mm and particularly preferably equal to or less than 41.5 mm. The core 4 may have two or more layers. The core 4 may have a rib on the surface thereof. The core 4 may be hollow.

The mid layer 6 is formed from a resin composition. A preferable base polymer of the resin composition is an ionomer resin. Examples of preferable ionomer resins include binary copolymers formed with an α-olefin and an α,β-unsaturated carboxylic acid having 3 to 8 carbon atoms. Examples of other preferable ionomer resins include ternary copolymers formed with: an α-olefin; an α,β-unsaturated carboxylic acid having 3 to 8 carbon atoms; and an α,β-unsaturated carboxylate ester having 2 to 22 carbon atoms. For the binary copolymer and the ternary copolymer, preferable α-olefins are ethylene and propylene, while preferable α,β-unsaturated carboxylic acids are acrylic acid and methacrylic acid. In the binary copolymer and the ternary copolymer, some of the carboxyl groups are neutralized with metal ions. Examples of metal ions for use in neutralization include sodium ion, potassium ion, lithium ion, zinc ion, calcium ion, magnesium ion, aluminum ion, and neodymium ion.

Instead of an ionomer resin, the resin composition of the mid layer 6 may include another polymer. Examples of the other polymer include polystyrenes, polyamides, polyesters, polyolefins, and polyurethanes. The resin composition may include two or more polymers.

The resin composition of the mid layer 6 may include a coloring agent such as titanium dioxide, a filler such as barium sulfate, a dispersant, an antioxidant, an ultraviolet absorber, a light stabilizer, a fluorescent material, a fluorescent brightener, and the like. For the purpose of adjusting specific gravity, the resin composition may include powder of a metal with a high specific gravity such as tungsten, molybdenum, and the like.

The mid layer 6 has a thickness of preferably 0.2 mm or greater and particularly preferably 0.3 mm or greater. The thickness of the mid layer 6 is preferably equal to or less than 2.5 mm and particularly preferably equal to or less than 2.2 mm. The mid layer 6 has a specific gravity of preferably 0.90 or greater and particularly preferably 0.95 or greater. The specific gravity of the mid layer 6 is preferably equal to or less than 1.10 and particularly preferably equal to or less than 1.05. The mid layer 6 may have two or more layers.

The cover 8 is formed from a resin composition. A preferable base polymer of the resin composition is a polyurethane. The resin composition may include a thermoplastic polyurethane or may include a thermosetting polyurethane. In light of productivity, the thermoplastic polyurethane is preferred. The thermoplastic polyurethane includes a polyurethane component as a hard segment, and a polyester component or a polyether component as a soft segment.

Examples of an isocyanate for the polyurethane component include alicyclic diisocyanates, aromatic diisocyanates, and aliphatic diisocyanates. Alicyclic diisocyanates are particularly preferred. Since an alicyclic diisocyanate does not have any double bond in the main chain, the alicyclic diisocyanate suppresses yellowing of the cover 8. Examples of alicyclic diisocyanates include 4,4'-dicyclohexylmethane diisocyanate ($H_{12}MDI$), 1,3-bis(isocyanatomethyl)cyclohexane ($H_6XDI$), isophorone diisocyanate (IPDI), and trans- 1,4-cyclohexane diisocyanate (CHDI). In light of versatility and processability, $H_{12}$MDI is preferred.

Instead of a polyurethane, the resin composition of the cover 8 may include another polymer. Examples of the other polymer include ionomer resins, polystyrenes, polyamides, polyesters, and polyolefins. The resin composition may include two or more polymers.

The resin composition of the cover 8 may include a coloring agent such as titanium dioxide, a filler such as barium sulfate, a dispersant, an antioxidant, an ultraviolet absorber, a light stabilizer, a fluorescent material, a fluorescent brightener, and the like.

The cover 8 has a thickness of preferably 0.2 mm or greater and particularly preferably 0.3 mm or greater. The thickness of the cover 8 is preferably equal to or less than 2.5 mm and particularly preferably equal to or less than 2.2 mm. The cover 8 has a specific gravity of preferably 0.90 or greater and particularly preferably 0.95 or greater. The specific gravity of the cover 8 is preferably equal to or less than 1.10 and particularly preferably equal to or less than 1.05. The cover 8 may have two or more layers.

The golf ball 2 may include a reinforcing layer between the mid layer 6 and the cover 8. The reinforcing layer firmly adheres to the mid layer 6 and also to the cover 8. The reinforcing layer suppresses separation of the cover 8 from the mid layer 6. Examples of the base polymer of the reinforcing layer include two-component curing type epoxy resins and two-component curing type urethane resins.

Figure 2:
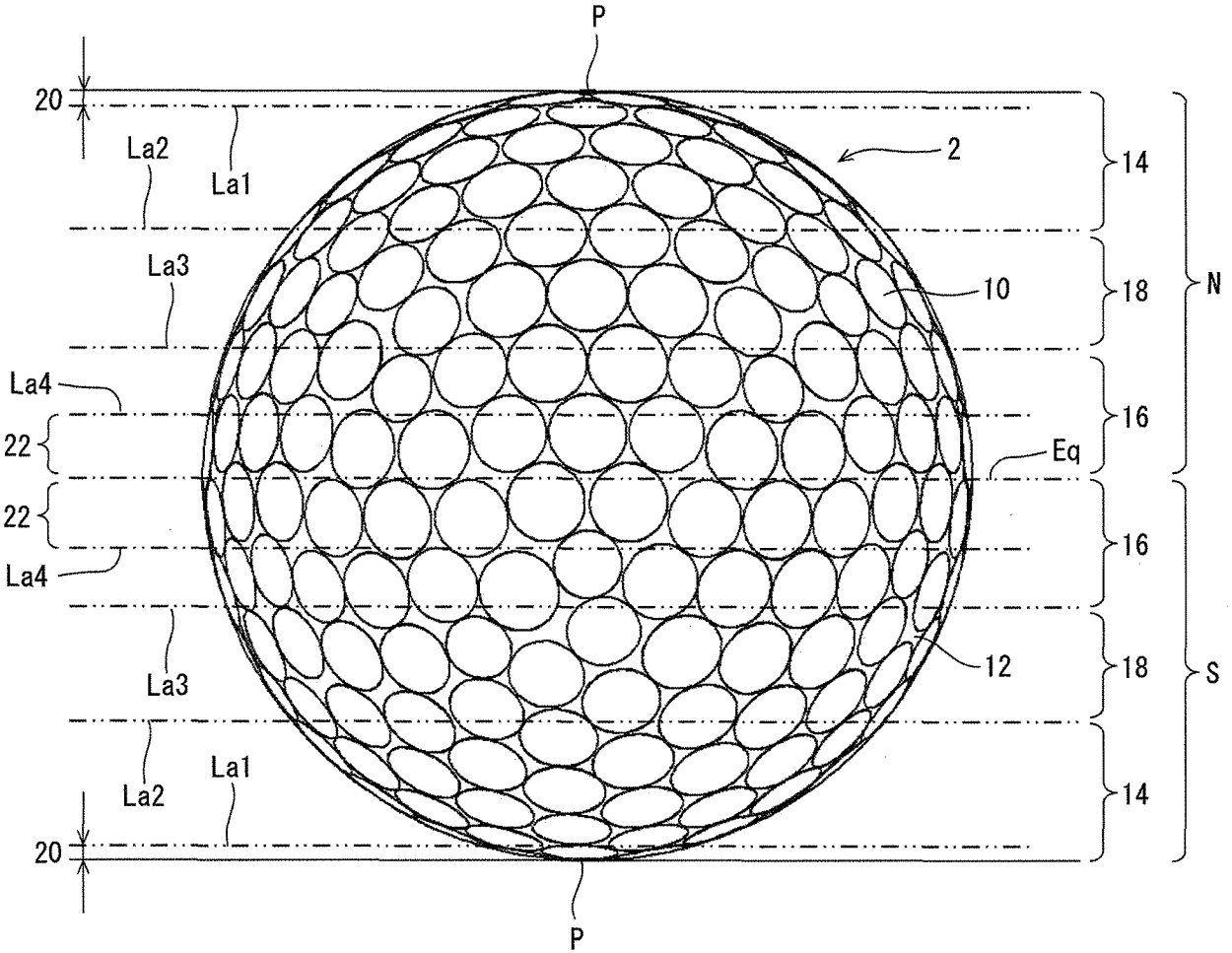
FIG. 2 is an enlarged front view of the golf ball in FIG. 1.

FIG. 2 is an enlarged front view of the golf ball 2 in FIG. 1. FIG. 2 depicts two poles P, two first latitude lines La1, two second latitude lines La2, two third latitude lines La3, two fourth latitude lines La4 and an equator Eq. A mold of the golf ball 2 includes upper and lower mold halves. One of the poles P coincides with the deepest point of the upper mold half. The other pole P coincides with the deepest point of the lower mold half. Each pole P has a latitude of 90°. The equator Eq has a latitude of 0°. The latitude of each first latitude line La1 is greater than the latitude of each second latitude line La2. The latitude of each second latitude line La2 is greater than the latitude of each third latitude line La3. The latitude of each third latitude line La3 is greater than the latitude of each fourth latitude line La4. The latitude of each fourth latitude line La4 is greater than the latitude of the equator Eq (0°). The first latitude line La1 has a latitude of 75°. The second latitude line La2 has a latitude of 40°. The third latitude line La3 has a latitude of 20°. The fourth latitude line La4 has a latitude of 10°.

The golf ball 2 has a northern hemisphere N above the equator Eq and a southern hemisphere S below the equator Eq. The dimple pattern of the southern hemisphere S and the dimple pattern of the northern hemisphere N are rotationally symmetrical to each other. Each of the northern hemisphere N and the southern hemisphere S has a high-latitude region 14, a low-latitude region 16, and a mid-latitude region 18. The second latitude line La2 is the boundary line between the high-latitude region 14 and the mid-latitude region 18. The third latitude line La3 is the boundary line between the mid-latitude region 18 and the low-latitude region 16. The high-latitude region 14 is surrounded by the second latitude line La2. The low-latitude region 16 is positioned between the third latitude line La3 and the equator Eq. The mid-latitude region 18 is positioned between the second latitude line La2 and the third latitude line La3. In other words, the mid-latitude region 18 is positioned between the high-latitude region 14 and the low-latitude region 16. The high-latitude region 14 has a latitude range of equal to or greater than 40° but equal to or less than 90°. The mid-latitude region 18 has a latitude range of equal to or greater than 20° but less than 40°. The low-latitude region 16 has a latitude range of equal to or greater than 0° but less than 20°.

The high-latitude region 14 includes a pole vicinity region 20. The pole vicinity region 20 is surrounded by the first latitude line La1. The pole vicinity region 20 has a latitude range of equal to or greater than 75° but equal to or less than 90°.

The low-latitude region 16 includes an equator vicinity region 22. The equator vicinity region 22 is sandwiched between the fourth latitude line La4 and the equator Eq. The equator vicinity region 22 has a latitude range of equal to or greater than 0° but less than 10°.

As is clear from FIG. 2, each of the dimples 10 has a circular plane shape. The golf ball 2 has dimples 10 belonging to the high-latitude region 14, dimples 10 belonging to the mid-latitude region 18, and dimples 10 belonging to the low-latitude region 16. Some of the dimples 10 that belong to the high-latitude region 14 also belong to the pole vicinity region 20. Some of the dimples 10 that belong to the low-latitude region 16 also belong to the equator vicinity region 22.

For each dimple 10 that intersects any one of the latitude lines, the region to which the dimple 10 belongs is determined based on the position of the center of the dimple 10. For example, the dimple 10 that intersects the first latitude line La1 and whose center is located in the pole vicinity region 20 belongs to the pole vicinity region 20. The dimple 10 that intersects the second latitude line La2 and whose center is located in the high-latitude region 14 belongs to the high-latitude region 14. The dimple 10 that intersects the second latitude line La2 and whose center is located in the mid-latitude region 18 belongs to the mid-latitude region 18. The dimple 10 that intersects the third latitude line La3 and whose center is located in the mid-latitude region 18 belongs to the mid-latitude region 18. The dimple 10 that intersects the third latitude line La3 and whose center is located in the low-latitude region 16 belongs to the low-latitude region 16. The dimple 10 that intersects the fourth latitude line La4 and whose center is located in the equator vicinity region 22 belongs to the equator vicinity region 22. The center of the dimple 10 is a point at which a straight line passing through the deepest part of the dimple 10 and the center of the golf ball 2 intersects a phantom sphere Sp (See FIG. 8).

Figure 3:
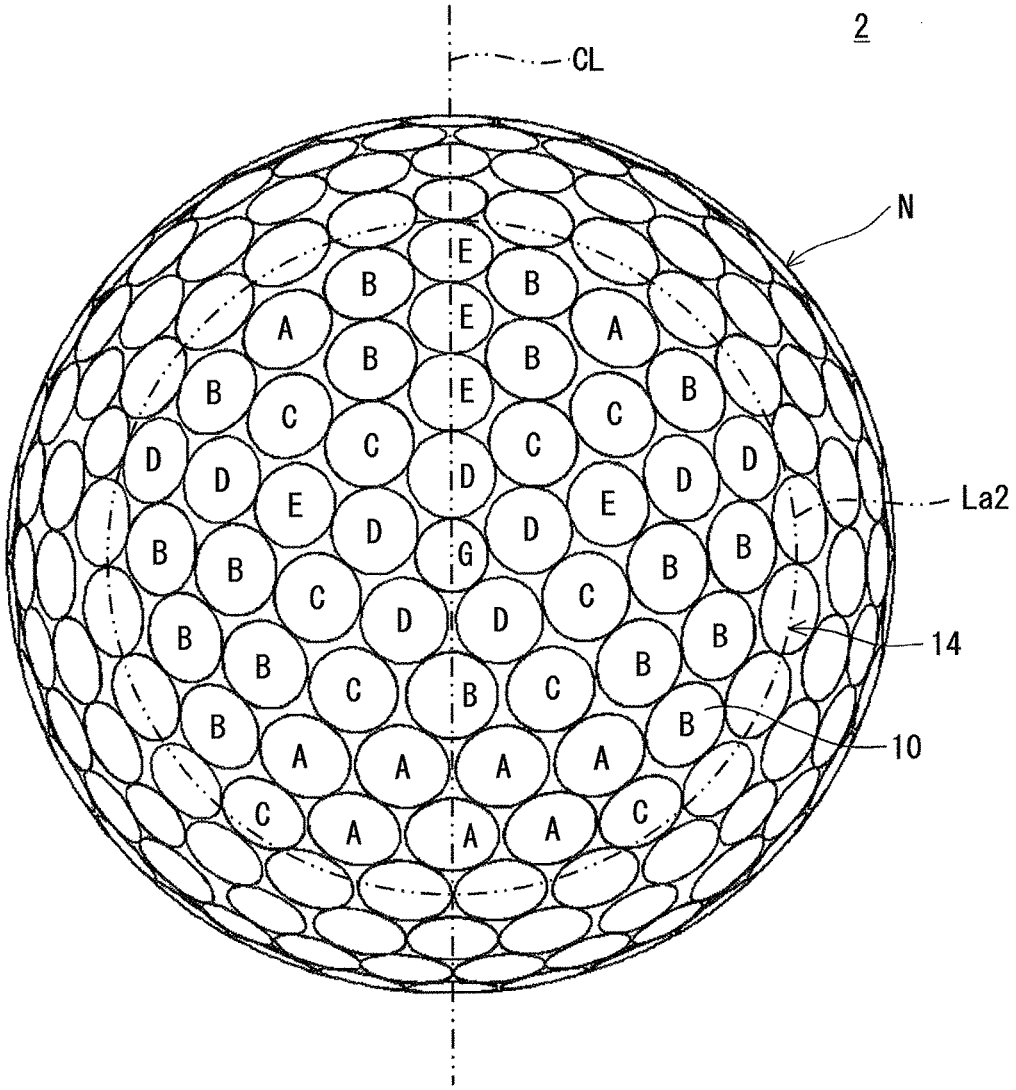
FIG. 3 is a plan view of the golf ball in FIG. 2.

FIG. 3 is a plan view of the golf ball 2 in FIG. 2. FIG. 3 shows the northern hemisphere N. A dimple pattern of the northern hemisphere N in the plan view is symmetrical about a center line CL. Therefore, a three-dimensional dimple pattern is mirror symmetrical about a plane that includes the center line CL and passes through the center of the golf ball 2. Another plane that can divide the dimple pattern so that divided dimple patterns are mirror symmetrical to each other does not exist. The number N2 of planes that can divide the dimple pattern so that divided dimple patterns are mirror symmetrical to each other is one. Also in the southern hemisphere S, the number N2 of planes that can divide the dimple pattern so that divided dimple patterns are mirror symmetrical to each other is one.

FIG. 3 shows the second latitude line La2. A zone surrounded by the second latitude line La2 is the high-latitude region 14. For the high-latitude region 14, types of the dimples 10 are indicated by the reference characters A, B, C, D, E and G. Each of the dimples 10 has a circular contour. The high-latitude region 14 includes: dimples A having a diameter of 4.60 mm; dimples B having a diameter of 4.50 mm; dimples C having a diameter of 4.40 mm;

dimples D having a diameter of 4.30 mm; dimples E having a diameter of 4.15 mm; and a dimple G having a diameter of 3.60 mm.

When the dimple pattern of the high-latitude region 14 is rotated about a straight line passing though the both poles P (See FIG. 2), the rotated dimple pattern does not agree with the dimple pattern before the rotation as long as the rotation angle is greater than 0° but less than 360°. In other words, the dimple pattern of the high-latitude region 14 is not rotationally symmetrical.

Figure 4:
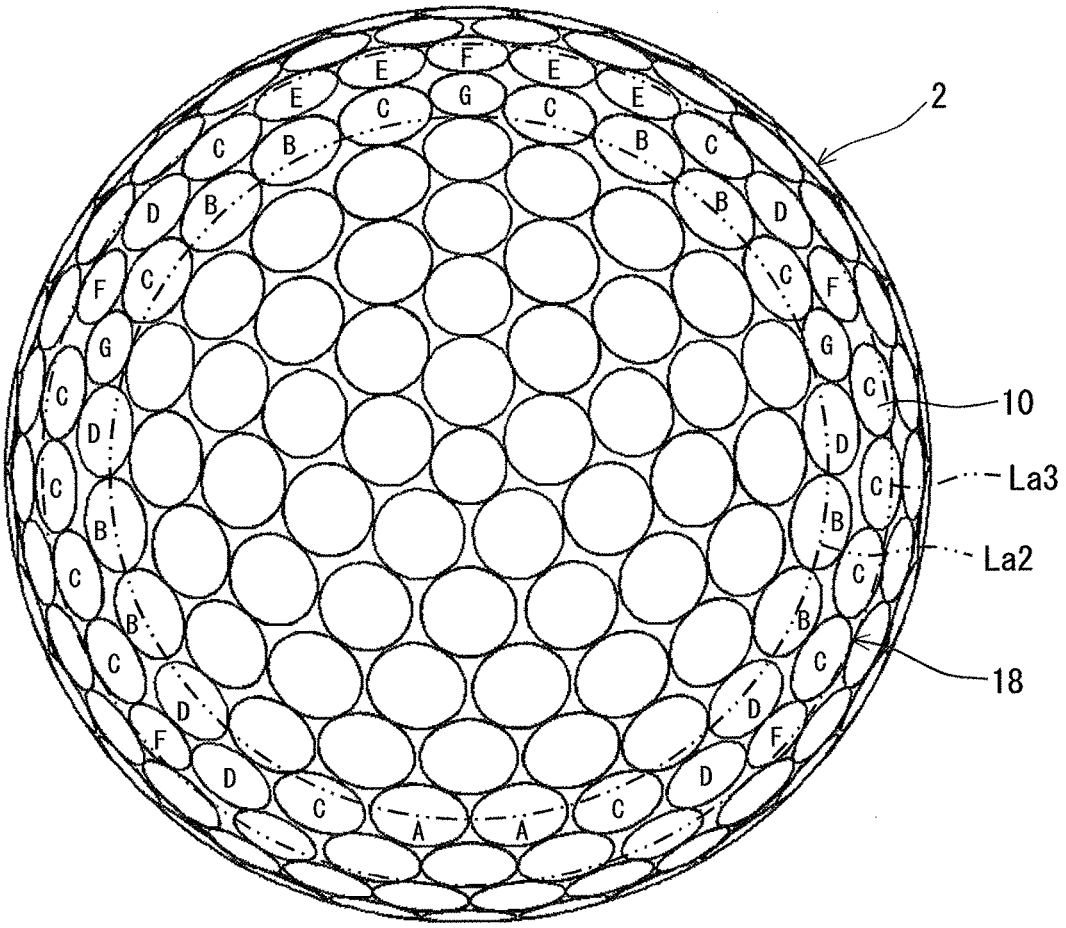
FIG. 4 is a plan view of the golf ball in FIG. 2.

FIG. 4 is a plan view of the golf ball 2 in FIG. 2. FIG. 4 shows the second latitude line La2 and the third latitude line La3. A zone sandwiched between the second latitude line La2 and the third latitude line La3 is the mid-latitude region 18. For the mid-latitude region 18, types of the dimples 10 are indicated by the reference characters B, C, D, E, F and G. Each of the dimples 10 has a circular contour. The mid-latitude region 18 includes: dimples B having a diameter of 4.50 mm; dimples C having a diameter of 4.40 mm; dimples D having a diameter of 4.30 mm; dimples E having a diameter of 4.15 mm; dimples F having a diameter of 3.85 mm; and dimples G having a diameter of 3.60 mm.

When the dimple pattern of the mid-latitude region 18 is rotated about the straight line passing though the both poles P (See FIG. 2), the rotated dimple pattern does not agree with the dimple pattern before the rotation as long as the rotation angle is greater than 0° but less than 360°. In other words, the dimple pattern of the mid-latitude region 18 is not rotationally symmetrical. The dimple pattern of the mid-latitude region 18 may be rotationally symmetrical. In a rotationally-symmetrical dimple pattern, at a rotation angle of greater than 0° but less than 360°, a rotated dimple pattern agrees with the dimple pattern before the rotation.

Figure 5:
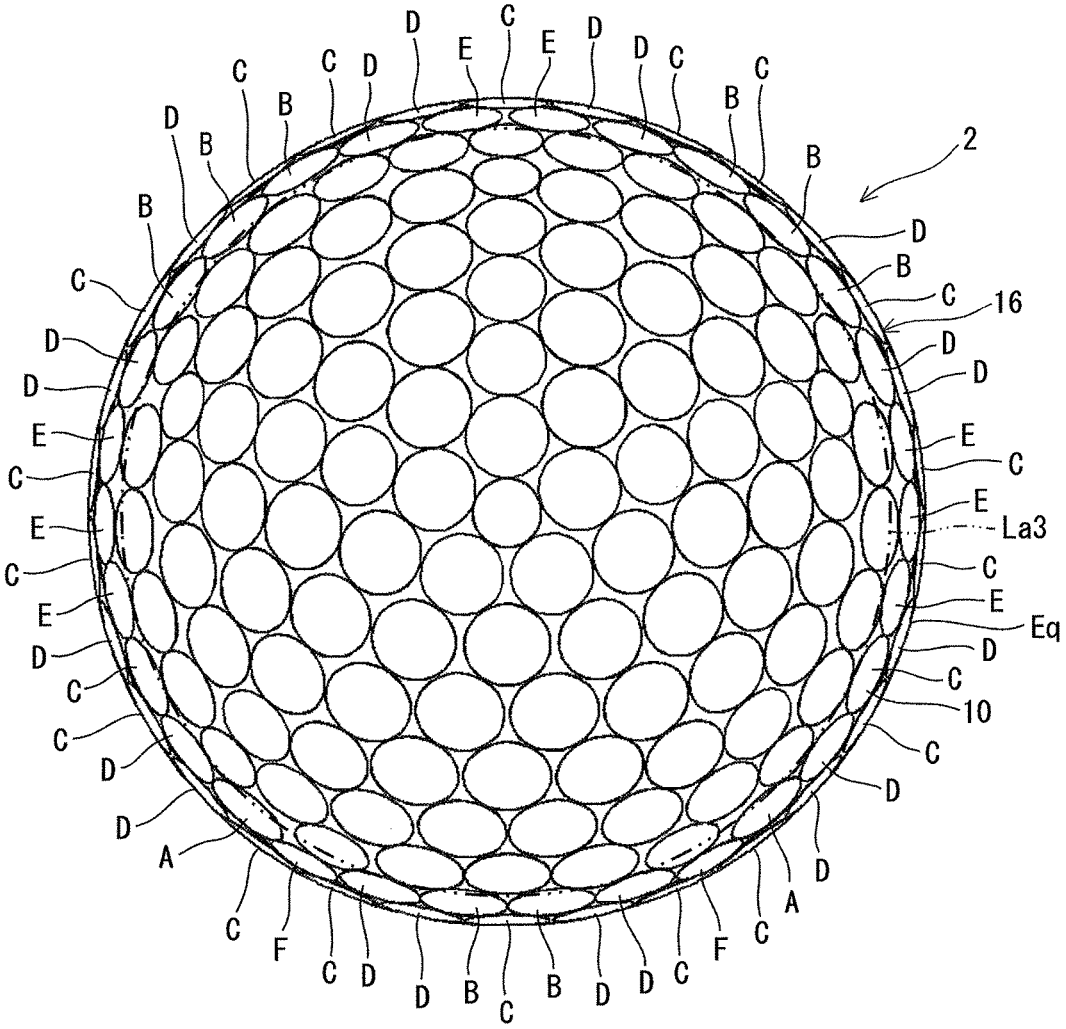
FIG. 5 is a plan view of the golf ball in FIG. 2.

FIG. 5 is a plan view of the golf ball 2 in FIG. 2. FIG. 5 shows the third latitude line La3. A zone sandwiched between the third latitude line La3 and the equator Eq (See FIG. 2) is the low-latitude region 16. For the low-latitude region 16, types of the dimples 10 are indicated by the reference characters A, B, C, D, E and F. Each of the dimples 10 has a circular contour. The low-latitude region 16 includes: dimples A having a diameter of 4.60 mm; dimples B having a diameter of 4.50 mm; dimples C having a diameter of 4.40 mm; dimples D having a diameter of 4.30 mm; dimples E having a diameter of 4.15 mm; and dimples F having a diameter of 3.85 mm.

When the dimple pattern of the low-latitude region 16 is rotated about the straight line passing though the both poles P (See FIG. 2), the rotated dimple pattern does not agree with the dimple pattern before the rotation as long as the rotation angle is greater than 0° but less than 360°. In other words, the dimple pattern of the low-latitude region 16 is not rotationally symmetrical.

In the golf ball 2, as already mentioned, the dimple pattern of the high-latitude region 14 is not rotationally symmetrical, and the dimple pattern of the low-latitude region 16 is not rotationally symmetrical, either. The dimple pattern of the golf ball 2 is not monotonous. The characteristic of the dimple pattern is similar to the characteristic of the random pattern. The dimple pattern accelerates turbulization.

As already mentioned, the dimple pattern of the golf ball 2 can be divided so that divided dimple patterns are mirror symmetrical to each other by a plane including the center line CL. In other words, the dimple pattern has a regularity as compared with a complete random pattern. Therefore, the dimple pattern has a great occupation ratio (to be detailed later). The number of planes that can divide a dimple pattern of the hemisphere so that divided dimple patterns are mirror symmetry to each other is as few as one. Therefore, the dimple pattern in not monotonous.

When the golf ball 2 having a dimple pattern that is not monotonous and has great occupation ratio is hit with a middle iron, an excessive lift force is not generated. The golf ball 2 is excellent in flight distance performance and flight distance stability in a shot with a middle iron.

As already mentioned, in the golf ball 2, the dimple pattern of the mid-latitude region 18 is not rotationally symmetrical, either. The golf ball 2 is extremely excellent in flight performance.

Figure 6:
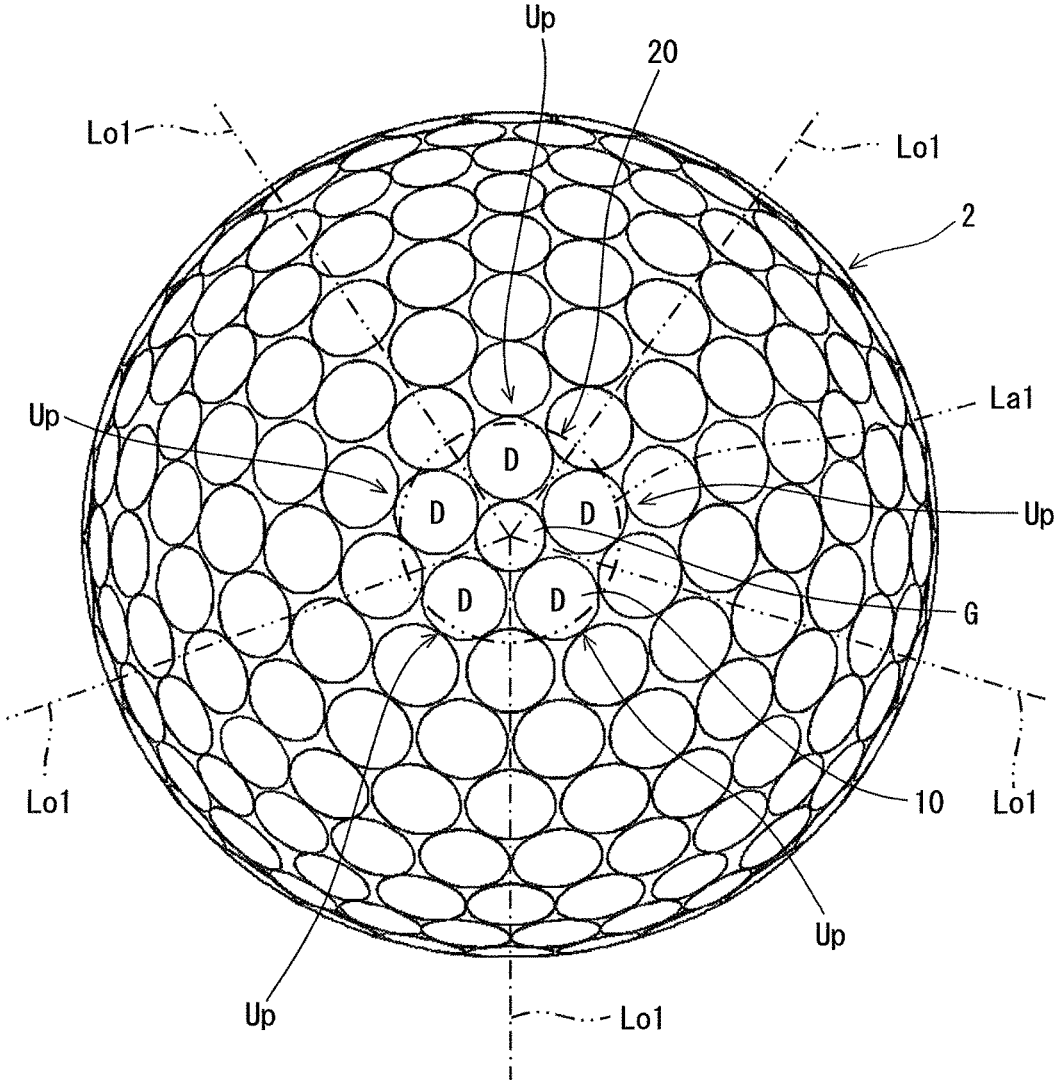
FIG. 6 is a plan view of the golf ball in FIG. 2.

FIG. 6 is a plan view of the golf ball 2 in FIG. 2. FIG. 6 shows the first latitude line La1 and five first longitude lines Lo1. In FIG. 6, a zone surrounded by the first latitude line La1 is the pole vicinity region 20. The pole vicinity region 20 can be divided into five units Up. Each of the units Up has a shape of a spherical triangle. The contour of the unit Up consists of the first latitude line La1 and two first longitude lines Lo1.

The dimple patterns of the five units Up are 72° rotationally symmetrical to each other. In other words, when the dimple pattern of one unit Up is rotated 72° in the latitude direction about the straight line passing through the both poles P (See FIG. 2), it substantially agrees with the dimple pattern of the adjacent unit Up. The rotationally symmetrical angle of the dimple pattern is 72°.

The golf ball 2 having a dimple pattern in the pole vicinity region 20 of rotationally symmetry is excellent in flight distance stability. The number of units of the pole vicinity region 20 is preferably 3 or greater but 6 or less. The pole vicinity region 20 may have a dimple pattern which is not rotationally symmetrical.

Figure 7:
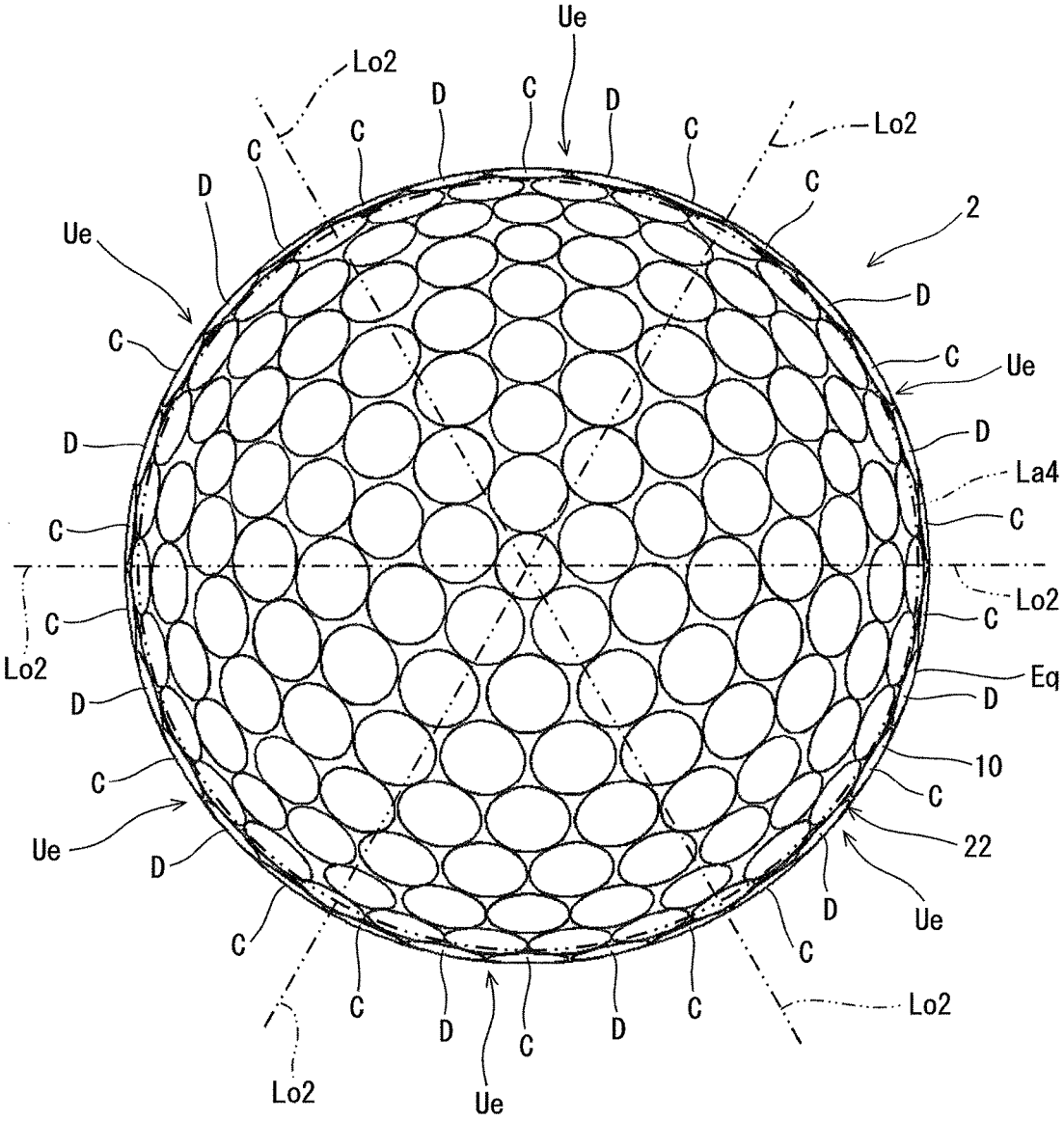
FIG. 7 is a plan view of the golf ball in FIG. 2.

FIG. 7 is a plan view of the golf ball 2 in FIG. 2. FIG. 7 shows the fourth latitude line La4 and six second longitude lines Lo2. In FIG. 7, a zone sandwiched between the fourth latitude line La4 and the equator Eq (See FIG. 2) is the equator vicinity region 22. The equator vicinity region 22 is divided into six units Ue. Each of the units Ue has a shape of a spherical trapezoid. The contour of the unit Ue consists of the fourth latitude line La4, two second longitude lines Lo2, and the equator Eq.

The dimple patterns of the six units Ue are 60° rotationally symmetrical to each other. In other words, when the dimple pattern of one unit Ue is rotated 60° in the latitude direction about the straight line passing through the both poles P (See FIG. 2), it substantially agrees with the dimple pattern of the adjacent unit Ue. The rotationally symmetrical angle of the dimple pattern is 60°.

The dimple pattern of the equator vicinity region 22 can also be divided into three units. In this case, the dimple pattern of each unit is 120° rotationally symmetrical to each other. The dimple pattern of the equator vicinity region 22 can also be divided into two units. In this case, the dimple pattern of each unit is 180° rotationally symmetrical to each other. The dimple pattern of the equator vicinity region 22 has three rotationally symmetrical angles (i.e., 60°, 120° and 180°). A region having a plurality of rotationally symmetrical angles is divided into units Ue based on the smallest rotationally symmetrical angle (60° in this example).

The golf ball 2 having a dimple pattern in the equator vicinity region 22 of rotational symmetry is excellent in flight distance stability. The golf ball 2 having a dimple pattern in the equator vicinity region 22 of rotational symmetry is easy to produce. The number of units of the equator vicinity region 22 is preferably 3 or greater but 6 or less. The equator vicinity region 22 may have a dimple pattern which is not rotationally symmetrical.

A great circle that exists on the surface of the golf ball 2 and that does not intersect any dimple 10 is referred to as a great circle path. The great circle path does not exist on the golf ball 2. The number N3 of the great circle paths is zero. In the golf ball 2, the flight distance does not have much dependence on the rotation axis of backspin. The golf ball 2 is excellent in flight distance stability.

Figure 8:
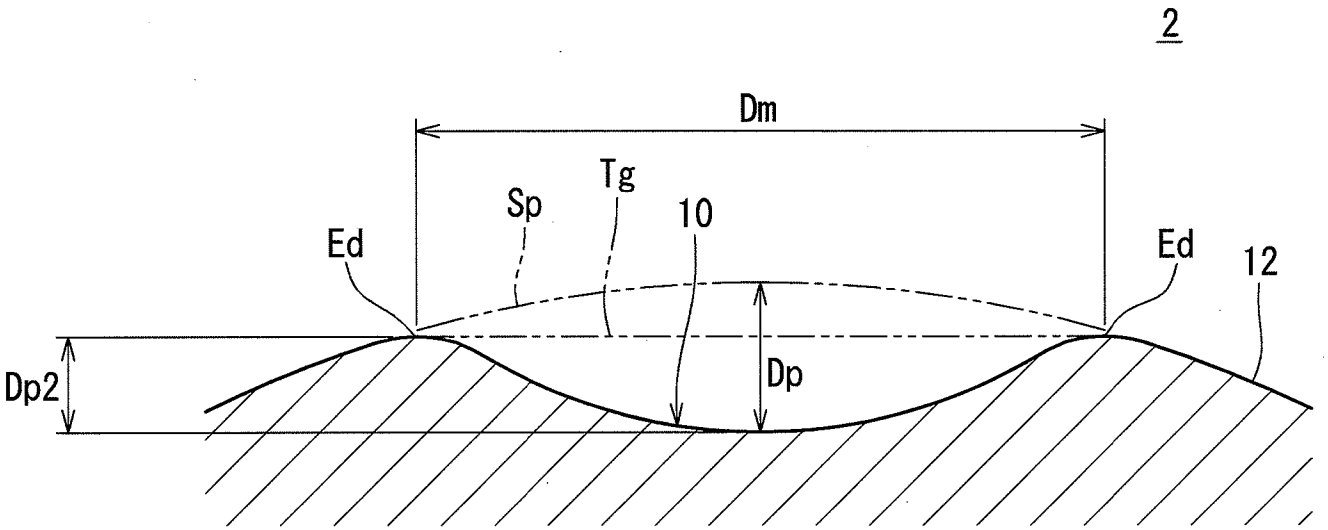
FIG. 8 is a schematic cross-sectional view of a portion of the golf ball in FIG. 1 in an enlarged manner.

FIG. 8 shows a cross section along a plane passing through the center of the dimple 10 and the center of the golf ball 2. In FIG. 8, the top-to-bottom direction is the depth direction of the dimple 10. In FIG. 8, a chain double-dashed line Sp represents a phantom sphere. The surface of the phantom sphere Sp is the surface of the golf ball 2 when it is postulated that no dimple 10 exists. The dimple 10 is recessed from the surface of the phantom sphere Sp. The land 12 coincides with the surface of the phantom sphere Sp. In the present embodiment, the cross-sectional shape of each dimple 10 is substantially a circular arc.

In FIG. 8, a double ended arrow Dm represents the diameter of the dimple 10. The diameter Dm is the distance between two tangent points Ed appearing on a tangent line Tg that is drawn tangent to the far opposite ends of the dimple 10. Each tangent point Ed is also the edge of the dimple 10. The edge Ed defines the contour of the dimple 10. In FIG. 8, a double ended arrow Dp represents the depth of the dimple 10. The depth Dp is the distance between the deepest part of the dimple 10 and the phantom sphere Sp.

The diameter Dm of each dimple 10 is preferably equal to or greater than 2.0 mm but equal to or less than 6.0 mm. The dimple 10 having a diameter Dm of 2.0 mm or greater contributes to turbulization. In this respect, the diameter Dm is more preferably equal to or greater than 2.5 mm and particularly preferably equal to or greater than 2.8 mm. The dimple 10 having a diameter Dm of 6.0 mm or less does not impair a fundamental feature of the golf ball 2 being substantially a sphere. In this respect, the diameter Dm is more preferably equal to or less than 5.5 mm and particularly preferably equal to or less than 5.0 mm.

In light of suppression of rising of the golf ball 2 during flight, the depth Dp of each dimple 10 is preferably equal to or greater than 0.10 mm, more preferably equal to or greater than 0.13 mm, and particularly preferably equal to or greater than 0.15 mm. In light of suppression of dropping of the golf ball 2 during flight, the depth Dp is preferably equal to or less than 0.60 mm, more preferably equal to or less than 0.55 mm, and particularly preferably equal to or less than 0.50 mm.

An area s of the dimple 10 is the area of a region surrounded by the contour line of the dimple 10 when the center of the golf ball 2 is viewed at infinity. In case of a circular dimple 10, the area S is calculated by the following formula.

$$S=(Dm/2)^2*n$$

In the golf ball 2 shown in FIGS. 2 to 7, the area of the dimple A is 16.62 $mm^2$; the area of the dimple B is 15.90 $mm^2$; the area of the dimple C is 15.21 $mm^2$; the area of the dimple D is 14.52 $mm^2$; the area of the dimple E is 13.53 $mm^2$; the area of the dimple F is 11.64 $mm^2$; and the area of the dimple G is 10.18 $mm^2$.

In the present invention, the ratio of the sum of the areas S of all the dimples 10 to the surface area of the phantom sphere Sp is referred to as an occupation ratio. From the standpoint that a sufficient dimple effect is achieved, the occupation ratio is preferably equal to or greater than 80%, more preferably equal to or greater than 82%, and particularly preferably equal to or greater than 84%. The occupation ratio is preferably equal to or less than 95%. In the golf ball 2 shown in FIGS. 2 to 7, the total area of the dimples 10 is 4812.0 $mm^2$. The surface area of the phantom sphere Sp of the golf ball 2 is 5728.0 $mm^2$, and thus the occupation ratio is 84.0%.

In light of achieving a sufficient occupation ratio, the total number N1 of the dimples 10 is preferably equal to or greater than 250, more preferably equal to or greater than 280, and particularly preferably equal to or greater than 300. From the standpoint that each dimple 10 can contribute to turbulization, the total number N1 is preferably equal to or less than 450, more preferably equal to or less than 400, and particularly preferably equal to or less than 380.

In the present invention, the term "dimple volume" means the volume of a part surrounded by the surface of the dimple 10 and a plane that includes the contour of the dimple 10. The total volume of all the dimples 10 of the golf ball 2 is preferably equal to or greater than 260 $mm^3$ but equal to or less than 360 $mm^3$, and particularly preferably equal to or greater than 290 $mm^3$ but equal to or less than 330 $mm^3$.

EXAMPLES

Example 1

A rubber composition was obtained by kneading 100 parts by weight of a high-cis polybutadiene (trade name "BR-730" manufactured by JSR Corporation), 22.5 parts by weight of zinc diacrylate, 5 parts by weight of zinc oxide, 5 parts by weight of barium sulfate, 0.5 parts by weight of diphenyl disulfide, and 0.6 parts by weight of dicumyl peroxide. This rubber composition was placed into a mold including upper and lower mold halves each having a hemispherical cavity, and heated at 170° C. for 18 minutes to obtain a core with a diameter of 38.5 mm.

A resin composition was obtained by kneading 50 parts by weight of an ionomer resin (trade name "Himilan 1605", manufactured by Du Pont-MITSUI POLYCHEMICALS Co., Ltd.), 50 parts by weight of another ionomer resin ("Himilan AM7329", manufactured by Du Pont-MITSUI POLYCHEMICALS Co., Ltd.), and 4 parts by weight of titanium dioxide with a twin-screw kneading extruder. The core was covered with this resin composition by injection molding to form a mid layer with a thickness of 1.6 mm.

A paint composition (trade name "POLIN 750LE", manufactured by SHINTO PAINT CO., LTD.) including a two-component curing type epoxy resin as a base polymer was prepared. The base material liquid of this paint composition includes 30 parts by weight of a bisphenol A type solid epoxy resin and 70 parts by weight of a solvent. The curing agent liquid of this paint composition includes 40 parts by weight of a modified polyamide amine, 55 parts by weight of a solvent, and 5 parts by weight of titanium dioxide. The weight ratio of the base material liquid to the curing agent liquid is 1/1. This paint composition was applied to the surface of the mid layer with a spray gun, and kept at 23° C. for 6 hours to obtain a reinforcing layer with a thickness of 10 μm.

A resin composition was obtained by kneading 100 parts by weight of a thermoplastic polyurethane elastomer (trade name "Elastollan XNY85A", manufactured by BASF Japan Ltd.) and 4 parts by weight of titanium dioxide with a twin-screw kneading extruder. Half shells were formed from this resin composition by compression molding. The sphere consisting of the core, the mid layer, and the reinforcing layer was covered with two of these half shells. The sphere and the half shells were placed into a final mold that includes upper and lower mold halves each having a hemispherical cavity and having a large number of pimples on its cavity face, and a cover was obtained by compression molding. The thickness of the cover was 0.5 mm. Dimples having a shape that is the inverted shape of the pimples were formed on the cover. A clear paint including a two-component curing type polyurethane as a base material was applied to this cover to obtain a golf ball of Example 1 with a diameter of about 42.7 mm and a weight of about 45.6 g. The specifications of the dimples of the golf ball are shown in Table 1 and 3 below.

TABLE 1

| Specifications of dimples | | | | | | | | |
|---|---|---|---|---|---|---|---|---|
| | Type | Number of dimples | Diameter Di (mm) | Depth Dp2 (mm) | Depth Dp (mm) | Curvature radius (mm) | Volume ($mm^3$) | Total volume ($mm^3$) |
| Ex. 1 | A | 30 | 4.60 | 0.135 | 0.2592 | 19.66 | 1.123 | 33.7 |
| | B | 68 | 4.50 | 0.135 | 0.2539 | 18.82 | 1.075 | 73.1 |
| | C | 92 | 4.40 | 0.135 | 0.2487 | 17.99 | 1.028 | 94.5 |
| | D | 74 | 4.30 | 0.135 | 0.2435 | 17.19 | 0.982 | 72.6 |
| | E | 38 | 4.15 | 0.135 | 0.2361 | 16.01 | 0.914 | 34.7 |
| | F | 14 | 3.85 | 0.135 | 0.2220 | 13.79 | 0.787 | 11.0 |
| | G | 8 | 3.60 | 0.135 | 0.2110 | 12.07 | 0.688 | 5.5 |
| Ex. 2 | A | 30 | 4.60 | 0.135 | 0.2592 | 19.66 | 1.123 | 33.7 |
| | B | 68 | 4.50 | 0.135 | 0.2539 | 18.82 | 1.075 | 73.1 |
| | C | 96 | 4.40 | 0.135 | 0.2487 | 17.99 | 1.028 | 98.7 |
| | D | 66 | 4.30 | 0.135 | 0.2435 | 17.19 | 0.982 | 64.8 |
| | E | 38 | 4.15 | 0.135 | 0.2361 | 16.01 | 0.914 | 34.7 |
| | F | 14 | 3.85 | 0.135 | 0.2220 | 13.79 | 0.787 | 11.0 |
| | G | 12 | 3.60 | 0.135 | 0.2110 | 12.07 | 0.688 | 8.3 |
| Ex. 3 | A | 14 | 4.60 | 0.135 | 0.2592 | 19.66 | 1.123 | 15.7 |
| | B | 62 | 4.50 | 0.135 | 0.2539 | 18.82 | 1.075 | 66.6 |
| | C | 72 | 4.40 | 0.135 | 0.2487 | 17.99 | 1.028 | 74.0 |
| | D | 92 | 4.30 | 0.135 | 0.2435 | 17.19 | 0.982 | 90.3 |
| | E | 46 | 4.15 | 0.135 | 0.2361 | 16.01 | 0.914 | 42.1 |
| | F | 16 | 3.85 | 0.135 | 0.2220 | 13.79 | 0.787 | 12.6 |
| | G | 20 | 3.60 | 0.135 | 0.2110 | 12.07 | 0.688 | 13.8 |

Examples 2 and 3 and Comparative Examples 1 to 5

Golf balls of Examples 2 and 3 and Comparative Examples 1 to 5 were obtained in the same method as Example 1, except the specifications of their dimples were as shown in Tables 1 to 3 below. The golf ball according to Comparative Example 1 has the same dimple pattern as that of Example described in JP2007-175267. The golf ball according to Comparative Example 2 has the same dimple pattern as that of Example described in JP2007-195591. The golf ball according to Comparative Example 3 has the same dimple pattern as that of Example 1 described in JP2013-153966. The golf ball according to Comparative Example 4 has the same dimple pattern as that of Comparative Example 4 described in JP2007-195591. The golf ball according to Comparative Example 5 has the same dimple pattern as that of Example described in JP2009-172192.

[Flight Test]

A #5-iron (trade name "SRIXON Z725", manufactured by DUNLOP SPORTS CO. LTD., shaft hardness: S, loft angle: 25.0°) was attached to a swing machine manufactured by Golf Laboratories, Inc. A golf ball was hit under the conditions of: a head speed of 41 m/sec; a launch angle of 14°; and a backspin rotation rate of 4600 rpm, and the carry was measured. The hitting with POP rotation and the hitting with PH rotation were carried out twenty times each to calculate the average of the carries. The results are shown in Tables 2 and 3 below. The rotation axis for PH rotation extends through the both poles P. The rotation axis for POP rotation is orthogonal to the rotation axis for PH rotation.

TABLE 2

| Results of Evaluation | | | | |
|---|---|---|---|---|
| | Comp. Ex. 1 | Comp. Ex. 2 | Comp. Ex. 3 | Comp. Ex. 4 |
| Rotationally symmetrical angle (degree) | | | | |
| High-latitude region | 72 | 72 | — | 90 |
| Mid-latitude region | — | — | — | 90 |
| Low-latitude region | 60 | — | 72 | 90 |
| Pole vicinity region | 72 | 72 | 60 | 90 |
| Equator vicinity region | 60 | — | 72 | 90 |
| Dimple N1 | 330 | 328 | 344 | 336 |
| Occupation ratio (%) | 81.6 | 82.1 | 85.3 | 77.0 |
| Total volume ($mm^3$) | 310.6 | 324.8 | 330.3 | 325.2 |
| Plane N2 | 1 | 1 | 1 | 4 |
| Great circle path N3 | 1 | 0 | 0 | 3 |
| Carry (m) | | | | |
| POP | 172.5 | 171.9 | 172.5 | 171.5 |
| PH | 171.0 | 171.0 | 171.2 | 170.4 |
| (POP + PH)/2 | 171.8 | 171.5 | 171.9 | 171.0 |
| POP − PH | 1.5 | 0.9 | 1.3 | 1.1 |

TABLE 3

Figure 9:
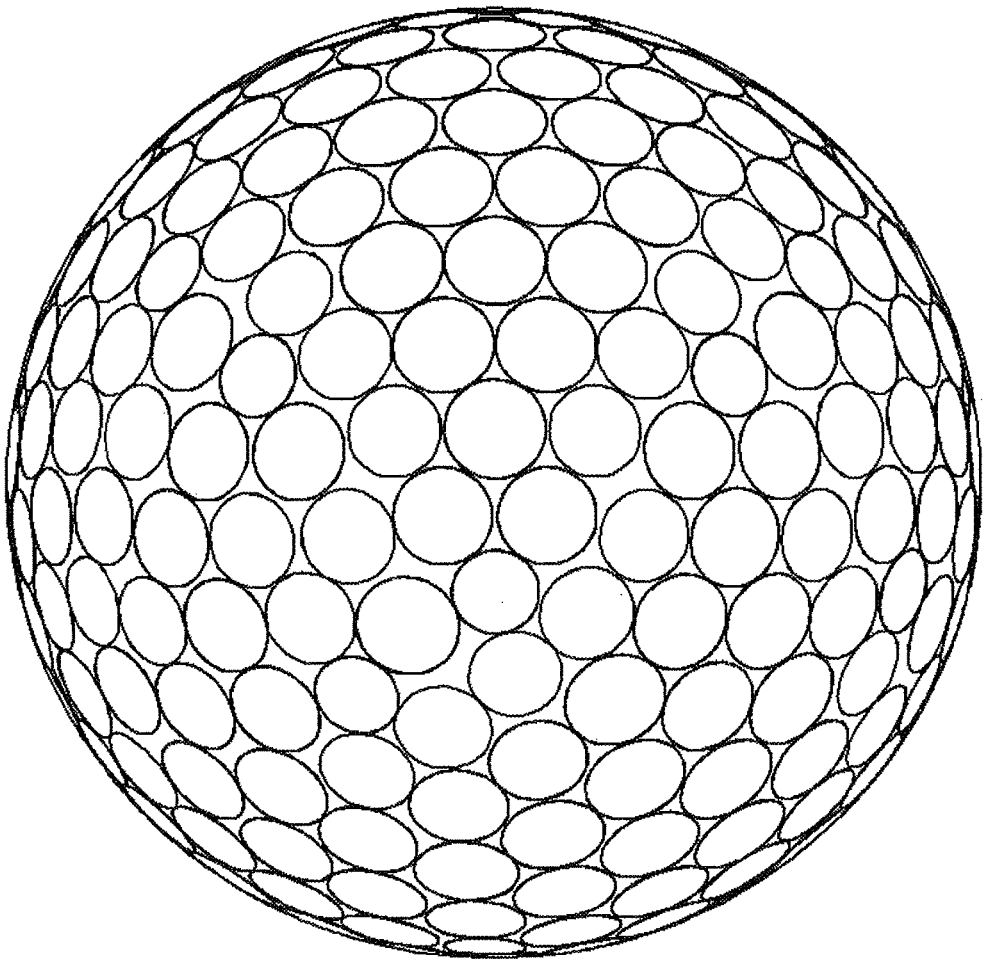
FIG. 9 is a front view of a golf ball according to Example 2 of the present invention.
Figure 10:
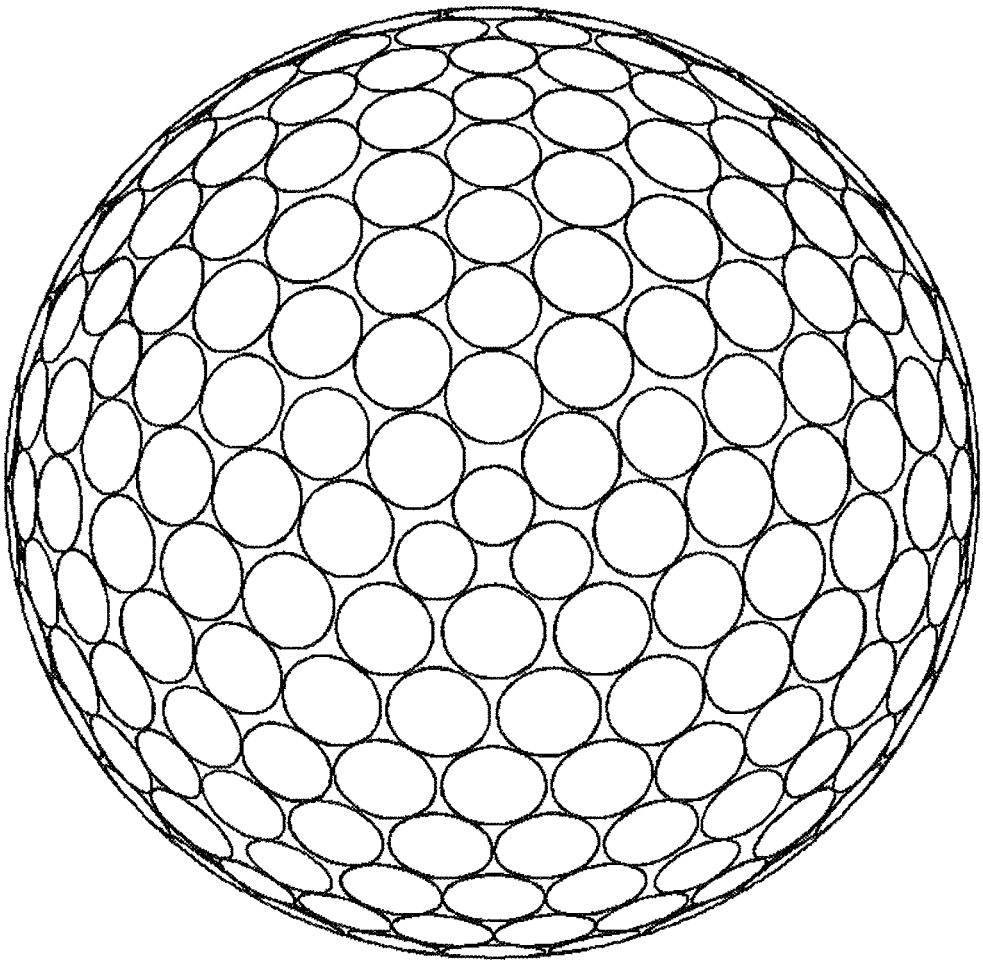
FIG. 10 is a plan view of the golf ball in FIG. 9.
Figure 11:
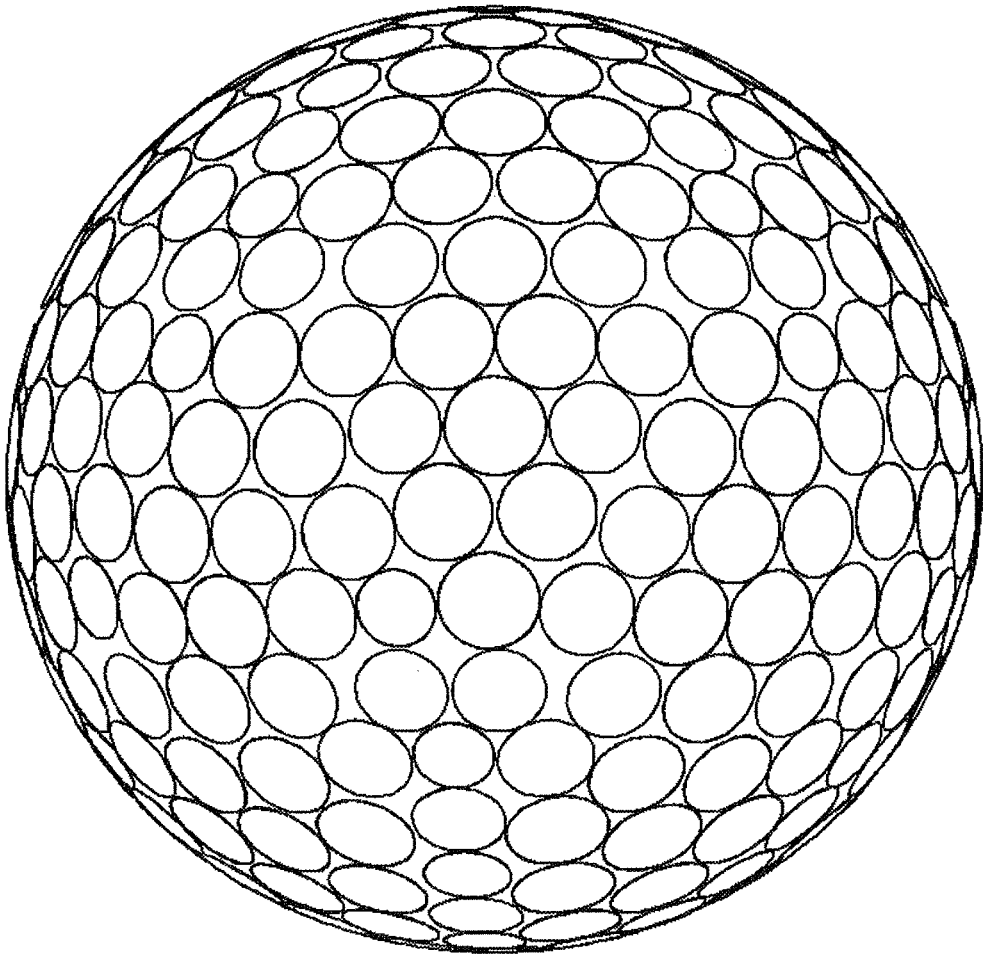
FIG. 11 is a front view of a golf ball according to Example 3 of the present invention.
Figure 12:
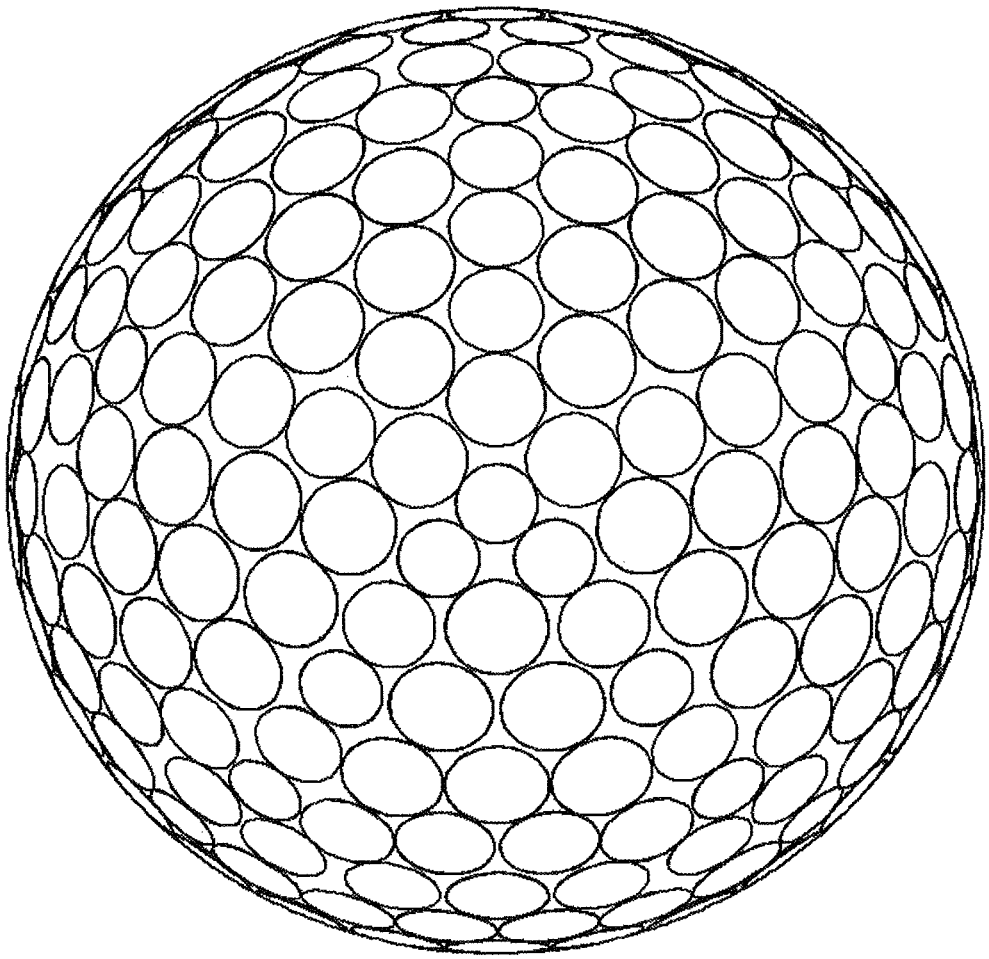
FIG. 12 is a plan view of the golf ball in FIG. 11.

| Results of Evaluation | | | | |
|---|---|---|---|---|
| | Comp. Ex. 5 | Ex. 1 | Ex. 2 | Ex. 3 |
| Front view | — | FIG. 2 | FIG. 9 | FIG. 11 |
| Plan view | — | FIG. 3 | FIG. 10 | FIG. 12 |
| Rotationally symmetrical angle (degree) | | | | |
| High-latitude region | — | — | — | — |
| Mid-latitude region | — | — | — | 72 |
| Low-latitude region | — | — | — | — |
| Pole vicinity region | — | 72 | — | — |

TABLE 3-continued

| Results of Evaluation | | | | |
|---|---|---|---|---|
| | Comp. Ex. 5 | Ex. 1 | Ex. 2 | Ex. 3 |
| Equator vicinity region | — | 60 | — | — |
| Dimple N1 | 384 | 324 | 324 | 322 |
| Occupation ratio (%) | 79.0 | 84.0 | 83.8 | 81.4 |
| Total volume ($mm^3$) | 325.0 | 325.2 | 324.2 | 315.1 |
| Plane N2 | 0 | 1 | 1 | 1 |
| Great circle path N3 | 0 | 0 | 0 | 0 |
| Carry (m) | | | | |
| POP | 171.6 | 173.1 | 172.8 | 172.6 |
| PH | 170.6 | 172.7 | 172.3 | 172.0 |
| (POP + PH)/2 | 171.1 | 172.9 | 172.6 | 172.3 |
| POP − PH | 1.0 | 0.4 | 0.5 | 0.6 |

As shown in Tables 1 to 3, each of the golf balls in Examples is excellent in flight distance performance and flight distance stability. From the results of evaluation, advantages of the present invention are clear.

The golf ball according to the present invention is suitable for playing golf on golf courses, practicing at driving ranges, and the like. The above description is merely for illustrative examples, and various modifications can be made without departing from the principles of the present invention.

What is claimed is:

1. A golf ball having a large number of dimples on a surface thereof, wherein when the surface is divided into a northern hemisphere and a southern hemisphere, each of the hemispheres includes a high-latitude region, a mid-latitude region and a low-latitude region, the high-latitude region has a latitude range of equal to or greater than 40° but equal to or less than 90°, the mid-latitude region has a latitude range of equal to or greater than 20° but less than 40°, the low-latitude region has a latitude range of equal to or greater than 0° but less than 20°, one plane can divide the hemisphere dimple pattern into divided dimple patterns that have mirror symmetry with respect to each other, the high-latitude region dimple pattern is not rotationally symmetrical, and the low-latitude region dimple pattern is not rotationally symmetrical.

2. The golf ball according to claim 1, wherein the mid-latitude region dimple pattern is not rotationally symmetrical.

3. The golf ball according to claim 1, wherein the high-latitude region includes a pole vicinity region, the pole vicinity region has a latitude range of equal to or greater than 75° but equal to or less than 90°, and the pole vicinity region dimple pattern is rotationally symmetrical.

4. The golf ball according to claim 1, wherein the low-latitude region includes an equator vicinity region, the equator vicinity region has a latitude range of equal to or greater than 0° but less than 10°, and the equator vicinity region dimple pattern is rotationally symmetrical.

5. The golf ball according to claim 1, wherein a great circle that does not intersect any dimple does not exist on the surface thereof.

6. The golf ball according to claim 1, wherein a ratio of a total area of the dimples to a surface area of a phantom sphere of the golf ball is equal to or greater than 80%.

7. The golf ball according to claim 3, wherein the pole vicinity region rotational angle is 60°, 72°, 90° or 120°.

8. The golf ball according to claim 4, wherein the equator vicinity region rotational angle is 60°, 72°, 90° or 120°.

* * * * *